United States Patent [19]

White

[11] 4,002,210

[45] Jan. 11, 1977

[54] FRICTION WHEEL ACTUATED POST DRIVER

[76] Inventor: Charles R. White, R.F.D., Calhoun City, Miss. 38916

[22] Filed: Aug. 28, 1975

[21] Appl. No.: 608,738

[52] U.S. Cl. ..... 173/26; 173/53; 173/42

[51] Int. Cl.[2] ..... E21B 1/00

[58] Field of Search ..... 173/53, 26, 42, 43, 173/124, 140

[56] References Cited

UNITED STATES PATENTS

| | | | |
|---|---|---|---|
| 2,348,820 | 5/1944 | Jordan et al. | 173/53 |
| 2,378,131 | 6/1945 | Dirksen et al. | 173/53 |
| 2,593,186 | 4/1952 | Richardson | 173/53 |
| 2,939,682 | 6/1960 | Kromberg | 173/26 |
| 3,482,639 | 12/1969 | Mixon | 175/53 |
| 3,783,953 | 1/1974 | Kopaska | 175/124 |

*Primary Examiner*—Ernest R. Purser
*Assistant Examiner*—Richard E. Favreau
*Attorney, Agent, or Firm*—Clarence A. O'Brien; Harvey B. Jacobson

[57] ABSTRACT

The guide frame of a post driver is supported in an adjusted position by the three-point hitch of a tractor and its driver element is displaced upwardly by a friction drive assembly carried by the guide frame and driven by a power take-off from the tractor. The guide frame is adjustably positioned both laterally and longitudinally of the forward direction of travel of the tractor vehicle.

8 Claims, 9 Drawing Figures

FRICTION WHEEL ACTUATED POST DRIVER

This invention relates to power operated post drivers of a type adapted to drive fence posts into the ground.

Fence post drivers and other similar apparatus employing driver elements that are displaced upwardly and dropped to drive a post by impact, are well known as disclosed in U.S. Pat. Nos. 2,348,820, 2,378,131, 2,487,530, 2,593,186, and 3,157,235. Such prior post drivers generally employ relatively complex driving mechanisms or drive mechansims that are separate from the post driver. Further, prior post driver apparatus for use in installing fence posts, are difficult to adjust in order to compensate for uneven terrain. It is therefore an important object of the present invention to provide a post driver apparatus carried by a tractor and capable of being adjusted to accommodate uneven terrain in connection with the installation of fence posts.

In accordance with the present invention, a fence post driver apparatus is adjustably supported by a tractor vehicle through its power operated, three-point hitch by means of which the driver apparatus may be easily transported to a desired location and adjusted to a desired position. A selectively engageable, friction drive assembly is carried on the guide column of the post driver apparatus and is driven by the power take-off device associated with the tractor vehicle. Lateral adjustment of the vertical guide column relative to the tractor vehicle is effected by means of a releasable coupling to the drawbar interconnecting the lift arms of the three-point hitch while a turnbuckle link device, interconnecting the guide column with one of the lift arms of the three-point hitch, is utilized to pivotally adjust the position of the guide column relative to the lift arms of the three-point hitch. A safety catch limits upward displacement of the driver element slidably mounted within the guide column and prevents its disassembly from the guide column.

These togehter with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
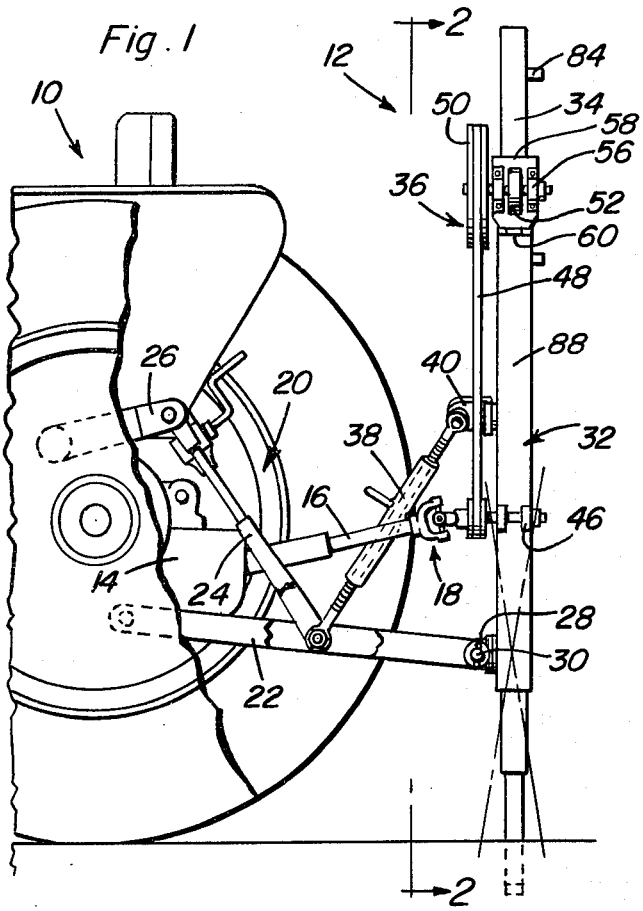
FIG. 1 is a side elevational view of the post driver apparatus of the present invention shown connected rearwardly of a tractor vehicle.

Referring now to the drawings in detail, FIG. 1 illustrates a tractor vehicle generally referred to by reference numeral 10 to which a post driver apparatus generally referred to by reference numeral 12 is connected and spaced rearwardly therefrom. The tractor vehicle 10 is of a conventional type and includes a power take-off transmission 14 from which a power take-off shaft 16 extends rearwardly, the power take-off shaft being drivingly coupled to the post driver apparatus 12 by means of a universal joint 18. Also associated with the tractor vehicle 10, is a conventional type of three-point hitch assembly generally denoted by reference numeral 20. The hitch assembly includes a pair of lift arms 22 pivotally mounted by the frame of the tractor vehicle and extending rearwardly therefrom. Lift bars 24 are pivotally connected to the lift arms intermediate the ends thereof, the upper ends of the lift bars being pivotally connected to a power lift lever 26. As is well known by those skilled in the art, the power operated three-point hitch assembly 12 is operative to raise or lower equipment connected to the hitch assembly through a drawbar 28 pivotally interconnected between the trailing ends of the lift arms 22 by pivot assemblies 30.

With continued reference to FIG. 1, it will be noted that the drawbar 28 associated with the hitch assembly 20 is connected to a guide frame column generally referred to by reference numeral 32 adjacent its lower end. Slidably carried by the guide column 32 is a driver element 34 shown projecting above and below the guide column. A friction drive assembly generally referred to by reference numeral 36 is carried by the guide column and is adapted to upwardly displace the driver element 34 as will be explained hereafter. The drive assembly 36 is coupled to the power take-off shaft 16 by means of the universal joint 18. Also interconnecting the hitch assembly 20 with the guide column 32 is an extensible link in the form of a turnbuckle device 38. The turnbuckle device is pivotally connected at its lower end to one of the lift arms 22 while it is pivotally connected by means of a pivot bracket 40 to an intermediate portion of the guide column 32.

Figure 8:
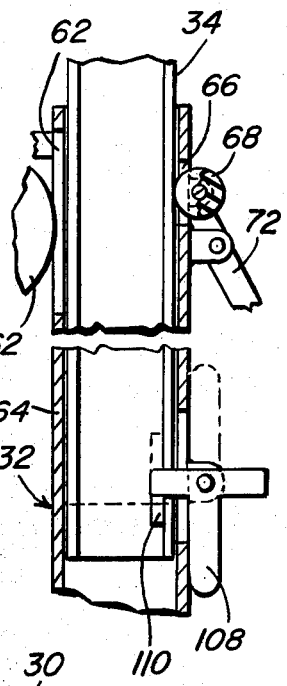
FIG. 8 is a partial side section view similar to that of FIG. 5 but showing the drive element in an upper limit position.
Figure 4:
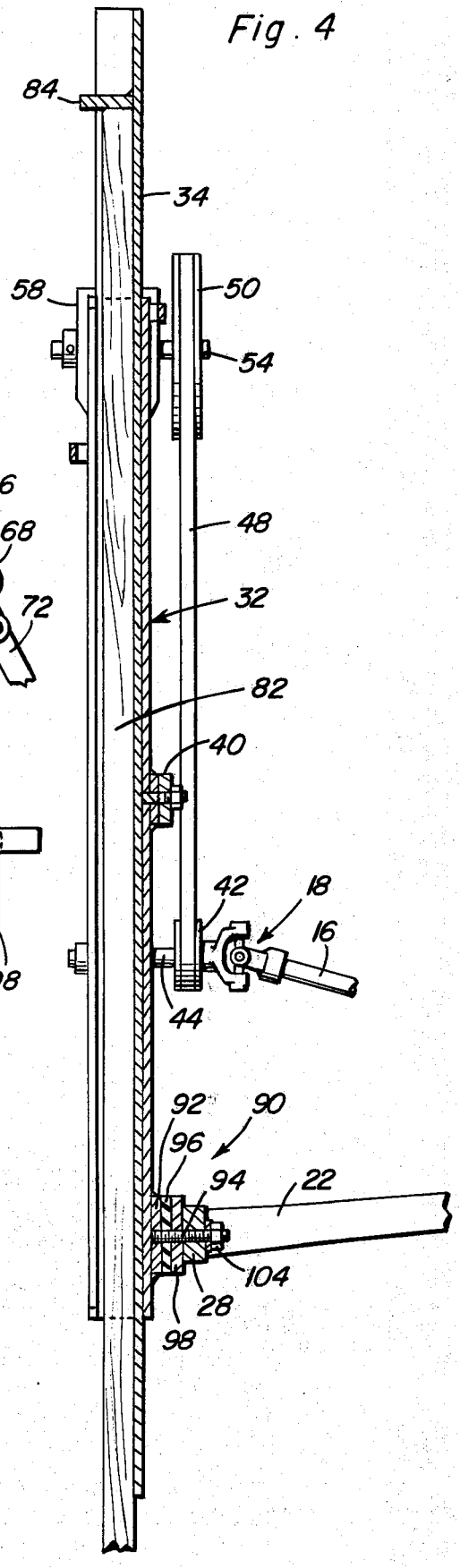
FIG. 4 is a partial sectional view taken substantially through a plane indicated by section line 4—4 in FIG. 2.

As shown in FIGS. 1, 2, 3, 4 and 5, the drive assembly 36 includes a drive pulley 42 connected to a drive shaft 44 which is journaled on the guide column 32 by spaced bearings 46. The drive shaft 44 is coupled by the universal joint 18 to the power take-off shaft 16. An endless drive belt 48 is entrained about the drive pulley 42 and about a larger diameter driven pulley 50. The driven pulley 50 is connected to a friction drive wheel 52 by means of a driven shaft 54 which is journaled by spaced bearings 56 carried on a support plate 58 that is pivotally connected to the guide column 32 by a hinge 60. Accordingly, the drive assembly 36 is pivotally displaceable about an axis fixed to the guide frame 32, established by the spaced bearings 46 rotatably mounting the drive shaft 44, in order to impart upward movement to the driver element 34 relative to the guide frame within which it is slidably mounted. Toward that end, the friction drive wheel 52 is aligned with an opening 62 formed in one of the side flanges 64 associated with the guide column 32 as more clearly seen in FIGS. 5 and 8. A smaller opening 66 is formed on the opposite flange 64 of the guide column as shown in FIG. 8 to accommodate a guide roller 68 rotatably mounted on the guide column for rolling contact with the driver element 34. The driver element is channel-shaped in cross section for continuous engagement by the guide roller 68 and selective engagement by the friction drive wheel 62.

Figure 2:
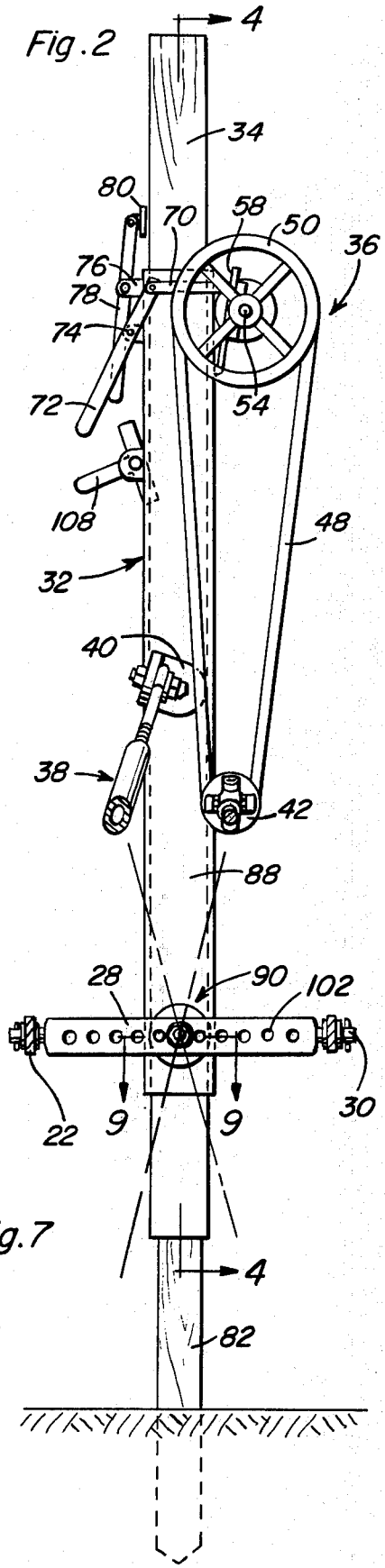
FIG. 2 is an enlarged front elevational view of the post driver apparatus as viewed from a plane indicated by section line 2—2 in FIG. 1.
Figure 5:
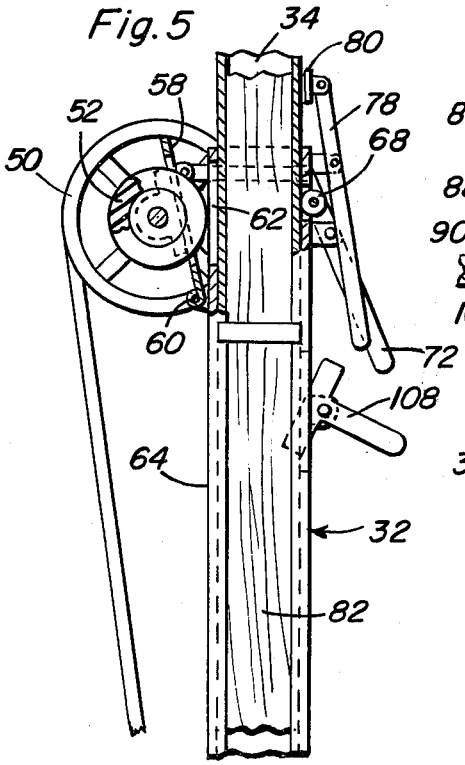
FIG. 5 is a partial side elevational view of the post driver apparatus as viewed from the side opposite that shown in FIG. 2 with parts broken away and shown in section.
Figure 7:
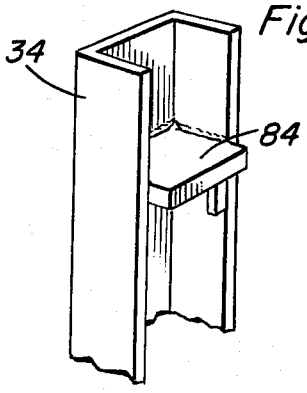
FIG. 7 is a perspective view of the upper portion of the driver element associated with the post driver apparatus.
Figure 3:
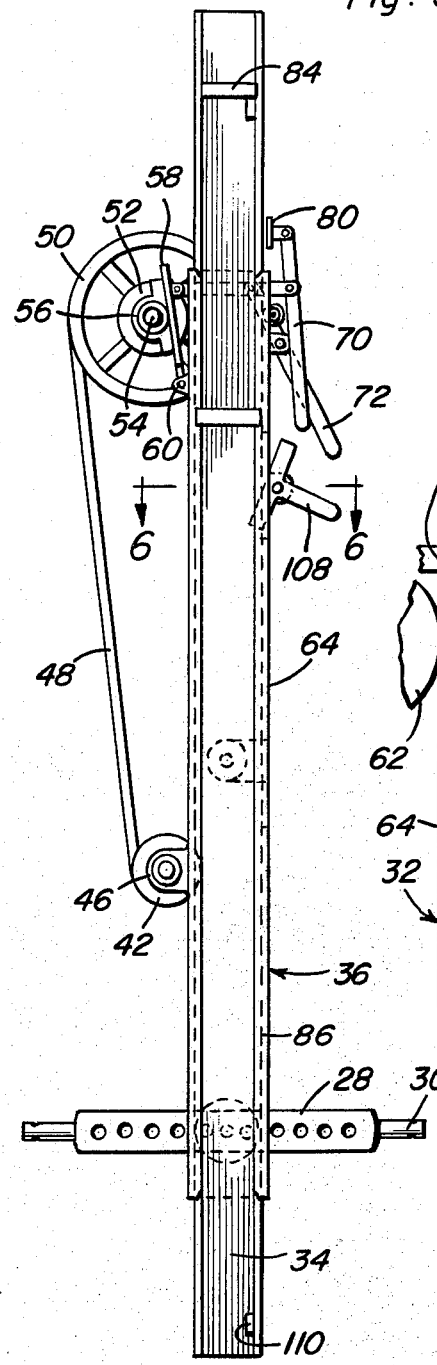
FIG. 3 is a rear elevational view of the post driver apparatus.

As more clearly seen in FIGS. 2 and 5, the hinged support plate 58 of the drive assembly is connected by a link 70 to one end of a drive control lever 72 which is pivotally mounted at a pivot 74 on the guide column adjacent its upper end. Pivotal displacement of the drive control lever 72 in a counterclockwise direction as viewed in FIG. 2 will therefore displace the friction drive wheel into engaging contact with the driver element for upward displacement thereof. Also pivotally mounted by a pivot bracket 76 on the guide column is a brake conrol lever 78, the upper end of which carries a pivotal brake shoe pad 80 adapted to engage one of the side flanges of the driver element. Accordingly, the driver element may be held in an upwardly displaced position by pulling on the lower end of the brake control lever 78 as a post 82 is positioned within the guide column and driver element below an impact abutment 84 secured to the driver element adjacent its upper end as more clearly seen in FIG. 7.

Figure 9:
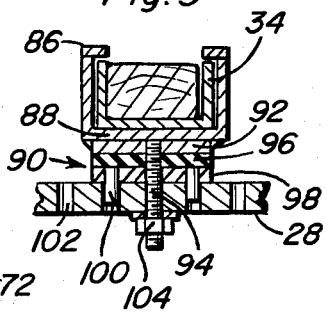
FIG. 9 is an enlarged transverse sectional view taken substantially through a plane indicated by section line 9—9 in FIG. 2.
Figure 6:
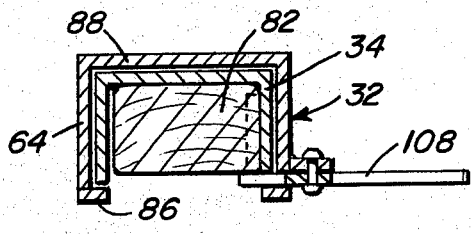
FIG. 6 is a transverse sectional view taken substantially through a plane indicated by section line 6—6 in FIG. 3.

As more clearly seen in FIGS. 6 and 9, the guide column 32 is provided with retainer flanges 86 on the side flanges 64 for holding the channel-shaped driver element 34 assembled therewithin for slidable displacement along the longitudinal axis of the guide column. The web portion 88 of the guide column carries the hinge 60 by means of which the support plate 58 is pivotally connected to the guide column adjacent the upper end while a coupling assembly 90 is carried by the web portion 88 of the guide column adjacent its lower end as more clearly seen in FIGS. 2, 4 and 9. The coupling assembly 90 includes a bearing element 92 secured as by welding to the web portion 88 of the guide column from which a threaded bolt shank 94 extends. A yieldable coupling disc 96 made of a material such as rubber is positioned on the bolt 94 in abutment with the bearing element. A rigid coupling disc 98 is also positioned on the bolt 94 in abutment with the coupling disc 96. A pair of pins 100 project from the coupling disc 98 into a pair of spaced adjustment holes 102 formed in the drawbar 28 on either side of a hole through which the bolt 94 extends. The coupling disc 98 is thereby non-rotatably coupled to the drawbar 28. An assembly nut 104 spaced from the drawbar 28 by a washer 106, bears against the drawbar 28 to clamp the frictional coupling disc 96 between the bearing disc 92 and the coupling disc 98 in order to hold the guide frame 32 in an angularly adjusted position relative to the drawbar. By loosening the nut 104 and repositioning the guide column 32, the guide column may be laterally adjusted. Adjustment of the position of the guide column 32 may also be effected by lengthening or shortening the turnbuckle device 38 causing the guide column to pivot about the pivot assemblies 30 in a plane parallel to the forward direction of travel of the tractor vehicle.

It will be apparent from the foregoing description, that when power is applied to the drive assembly 36 through the power take-off shaft 16, the operator of the post driver apparatus may upwardly displace the driver element 34 to a desired position by merely pushing the lower end of the drive control lever 72 inwardly toward the guide column resulting in the rotating friction drive wheel 52 being pressed into engagement with the side flange of the driver element. The driver element will accordingly be displaced upwardly to the desired position whereupon the lever 72 is released. The driver element may then be held in its upper position by pulling outwardly the lower end of the brake lever 78 bringing the brake shoe 80 into engagement with the side of the driver element above the upper end of the guide column. A safety catch 108 is pivotally mounted on the guide column to limit upward displacement of the driver element 34 and prevent disassembly thereof from the guide column. A catch bar 110 is connected as by welding adjacent to the lower end of the driver element and projects laterally therefrom so that it will engage the catch element 108 which normally projects into the guide column as shown in FIGS. 2, 3, 5, and 6. In its upper limit position, the catch bar 110 will be engaged by the arm of the safety catch element 108 as shown in FIG. 8. If desired, the driver element 34 may be held in its upper position by holding the catch element withdrawn from the guide column so as to permit the driver element to be raised thereabove after which the catch element is angularly displaced counterclockwise as viewed in FIGS. 3, 5 and 8 to the position shown by dotted line in FIG. 8. The catch bar 110 will then rest on the inwardly projecting arm of the safety catch to hold the driver element in its upper position.

With the guide column raised to an upper position by means of the three-point hitch through the lift arms 22 and the driver element held in an upper position by means of the brake shoe 80, a post may be inserted into the driver element from below. The guide column may then be lowered to a position as shown in FIG. 1 and upon release of the brake lever 78, the driver element will drop downwardly until the post abutment element 84 engages the upper end of the post 82 with impact. The driver element may then be again elevated to an upper position and dropped to impart another impact blow to the top of the post. In this fashion, the post may be driven into the ground to a desired depth.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a post driver having a guide column and support means therefor, adjustable means for connecting the column to the support means including a coupling disc having spaced pins projecting therefrom into the support means, a bearing element secured to the guide column, a yieldable coupling element spacing the bearing element from the coupling disc and releasable fastener means interconnected between the support means and the guide column for clamping the coupling element between the bearing element and the coupling disc corresponding to a laterally adjusted position of the guide column.

2. In combination with a tractor vehicle having a longitudinal axis and a hitch including a pair of lift arms and a drawbar interconnected between the lift arms, a post driver apparatus, comprising an elongated guide column, a driver element slidably mounted by said guide column, drive means carried by the guide column for upwardly displacing the driver element along an adjusted vertical direction of travel intersecting said longitudinal axis, and adjustable support means connecting the guide column to the drawbar between said lift arms for angularly adjusting said adjusted vertical direction of travel relative to the longitudinal axis.

3. In combination with a tractor vehicle having a hitch including a pair of lift arms and a drawbar interconnected between the lift arms, a post driver apparatus, comprising an elongated guide column, a driver element slidably mounted by said guide column, drive means carried by the guide column for upwardly displacing the driver element along an adjusted vertical direction of travel, and support means connecting the hitch to the guide column for establishing said adjusted vertical direction of travel relative to the tractor vehicle, said adjustable support means including a coupling disc having spaced pins projecting therefrom into the drawbar, a bearing element secured to the guide column, a yieldable coupling element spacing the bearing element from the coupling disc and releasable fastener means interconnected between the drawbar and the guide column for clamping the coupling element between the bearing element and the coupling disc corresponding to a laterally adjusted position of the guide column.

4. The combination of claim 3 including a safety element mounted on the guide column and engageable by the driver element for limiting said upward displacement thereof to prevent disassembly from the guide column.

5. The combination of claim 3 wherein the adjustable support means further includes an extensible link element interconnecting one of the lift arms with the guide column in a longitudinally adjusted position relative to the tractor vehicle.

6. The combination of claim 3 including a power take-off device, said drive means being movably mounted on the guide column for engagement with said driver element to upwardly displace the same, selective control means mounted on the guide column for displacement of the drive means into engagement with the driver element, and means coupling the power take-off device to the drive means.

7. The combination of claim 6 wherein the adjustable support means further includes an extensible link element interconnecting one of the lift arms with the guide column in a longitudinally adjusted position relative to the tractor vehicle.

8. The combination of claim 7 including a safety element mounted on the guide column and engageable by the driver element for limiting said upward displacement thereof to prevent disassembly from the guide column.

* * * * *